US008683759B2

(12) United States Patent
Lythgoe

(10) Patent No.: US 8,683,759 B2
(45) Date of Patent: Apr. 1, 2014

(54) PRE-CAST POLYGONAL SHELTER

(76) Inventor: Lane Lythgoe, Heber, UT (US)

( * ) Notice: Subject to any disclaimer, the term of this patent is extended or adjusted under 35 U.S.C. 154(b) by 281 days.

(21) Appl. No.: 13/007,024

(22) Filed: Jan. 14, 2011

(65) Prior Publication Data

US 2011/0173899 A1 Jul. 21, 2011

Related U.S. Application Data

(60) Provisional application No. 61/296,512, filed on Jan. 20, 2010.

(51) Int. Cl.

| | |
|---|---|
| ***E04H 1/00*** | (2006.01) |
| ***E04H 3/00*** | (2006.01) |
| ***E04B 1/00*** | (2006.01) |
| ***E02D 27/00*** | (2006.01) |
| ***E04B 1/38*** | (2006.01) |

(52) U.S. Cl.

USPC ..... 52/169.6; 52/79.11; 52/79.4; 52/79.7; 52/285.1; 52/259

(58) Field of Classification Search

USPC ..... 52/169.1, 169.6, 79.8, 79.9, 79.11, 52/79.4, 79.7, 79.1, 293.1, 272, 274, 281, 52/282.3, 284, 285.1, 262, 264, 270, 259

See application file for complete search history.

(56) References Cited

U.S. PATENT DOCUMENTS

| | | | | | |
|---|---|---|---|---|---|
| 1,477,867 | A | * | 12/1923 | Dodson | 52/223.7 |
| 1,813,909 | A | * | 7/1931 | Brainard et al. | 52/601 |
| 2,160,225 | A | * | 5/1939 | Newman | 52/293.3 |
| 2,886,855 | A | * | 5/1959 | Petter | 52/79.4 |
| 3,152,366 | A | * | 10/1964 | McCrory et al. | 52/79.4 |
| 3,374,593 | A | * | 3/1968 | Rensch | 52/283 |
| 3,836,218 | A | * | 9/1974 | Hallal | 312/111 |
| 3,994,105 | A | * | 11/1976 | Jamison et al. | 52/127.12 |
| 4,018,021 | A | | 4/1977 | Dow | |
| 4,019,293 | A | * | 4/1977 | Armas | 52/79.11 |
| 4,100,705 | A | | 7/1978 | Diana | |
| 4,295,307 | A | * | 10/1981 | Jensen | 52/236.1 |
| 4,336,674 | A | * | 6/1982 | Weber | 52/169.6 |
| 4,359,845 | A | * | 11/1982 | Harrison | 52/169.6 |
| 4,598,515 | A | | 7/1986 | Diana | |
| 4,655,013 | A | | 4/1987 | Ritland | |
| 4,779,388 | A | | 10/1988 | Gibney | |

(Continued)

FOREIGN PATENT DOCUMENTS

| | | | |
|---|---|---|---|
| DE | 3614914 | A1 * | 11/1987 |
| FR | 2615884 | A1 * | 12/1988 |

OTHER PUBLICATIONS

Machine Translation of FR 2615884 A1.*
Machine Translation of DE 3614914 A1.*

*Primary Examiner* — Ryan Kwiecinski
(74) *Attorney, Agent, or Firm* — Benjamin T. Miskin

(57) ABSTRACT

A pre-cast housing shelter unit includes: a polygonal floor surface; a plurality of pre-cast wall panels arranged in a polygonal shape adjacent the floor surface; a plurality of pre-made connectors positioned between each of the wall panels at corners of the polygonal floor surface, wherein the connectors are attached in place on the floor surface on-site; and at least one ceiling panel attached to the wall panels, wherein the housing shelter is sealed, in which the building structure is configured to support life and provide protection from disasters.

17 Claims, 13 Drawing Sheets

(56) References Cited

U.S. PATENT DOCUMENTS

| | | | | |
|---|---|---|---|---|
| 4,964,252 | A * | 10/1990 | Guliker | 52/275 |
| 5,044,134 | A * | 9/1991 | Brockway | 52/79.1 |
| 6,173,547 | B1 * | 1/2001 | Lipson | 52/582.1 |
| 6,263,637 | B1 * | 7/2001 | Spene et al. | 52/745.02 |
| 6,446,414 | B1 * | 9/2002 | Bullard et al. | 52/764 |
| 6,463,702 | B1 | 10/2002 | Weaver et al. | |
| 6,843,025 | B2 * | 1/2005 | Paz | 52/79.1 |
| 6,981,347 | B1 | 1/2006 | Walburger | |
| 8,256,168 | B2 * | 9/2012 | Bigger | 52/79.2 |
| 2002/0011035 | A1 * | 1/2002 | Boyer et al. | 52/79.5 |
| 2004/0134162 | A1 * | 7/2004 | Douglas | 52/741.1 |
| 2004/0177568 | A1 * | 9/2004 | Hanks | 52/79.1 |
| 2006/0143995 | A1 | 7/2006 | Beal | |
| 2007/0266651 | A1 * | 11/2007 | Harig et al. | 52/169.6 |
| 2008/0127584 | A1 * | 6/2008 | Schiffmann et al. | 52/293.3 |
| 2009/0025307 | A1 | 1/2009 | Crichlow | |
| 2009/0049760 | A1 * | 2/2009 | Stuck | 52/79.1 |
| 2011/0131897 | A1 * | 6/2011 | Martinez Navarrete et al. | 52/169.6 |
| 2011/0289860 | A1 * | 12/2011 | Wilson | 52/79.5 |

* cited by examiner

PRE-CAST POLYGONAL SHELTER

CROSS-REFERENCE TO RELATED APPLICATION

The present application claims priority under 35 U.S.C. §119(e) from previous U.S. Provisional Patent Application No. 61/296,512 by Lane Lythgoe entitled, "Pre-Cast Polygonal Shelter" filed Jan. 20, 2010, which provisional application is hereby incorporated by reference in its entirety.

BACKGROUND

During a disaster, whether natural or man-made, a housing shelter may often be desired and even necessary to provide protection for people, pets, and possessions, among other items, from conditions relating to such disasters.

Additionally, because some disasters can have effects that linger for long periods of time, a shelter constructed to protect occupants and their possessions ideally is able to sustain life for a specified duration of time longer than the effects of a disaster.

SUMMARY

Embodiments of an apparatus are described. In one embodiment, the apparatus is a pre-cast housing shelter unit. The shelter unit includes: a polygonal floor surface; a plurality of pre-cast wall panels arranged in a polygonal shape adjacent the floor surface; a plurality of pre-made connectors positioned between each of the wall panels at corners of the polygonal floor surface, wherein the connectors are attached in place on the floor surface on-site; and at least one ceiling panel attached to the wall panels, wherein the housing shelter is sealed, in which the building structure is configured to support life and provide protection from disasters. Other embodiments of the apparatus are also described, including a housing shelter having multiple units.

Embodiments of a method are also described. In one embodiment, the method is a method for constructing a unit of a pre-cast housing shelter. The method includes: casting a polygonal floor surface at an on-site location; connecting a plurality of pre-made connectors to the polygonal floor surface, wherein each of the pre-made connectors is placed at a corner of the polygonal floor surface; inserting pre-cast wall panels in between the connectors, wherein the wall panels enclose the polygonal floor surface; and attaching a pre-cast ceiling panel on top of the wall panels. Other embodiments of the method are also described.

Other aspects and advantages of embodiments of the present invention will become apparent from the following detailed description, taken in conjunction with the accompanying drawings, illustrated by way of example of the principles of the invention.

BRIEF DESCRIPTION OF THE DRAWINGS

The accompanying drawings illustrate various embodiments of the principles described herein and are a part of the specification. The illustrated embodiments are merely examples and do not limit the scope of the claims.

Throughout the drawings, identical reference numbers designate similar, but not necessarily identical, elements.

DETAILED DESCRIPTION

Figure 1A:
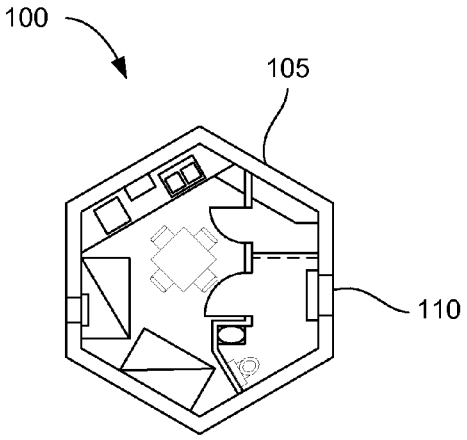
FIG. 1A-1C are illustrative diagrams showing housing shelters having various numbers of units, according to principles described herein.

It will be readily understood that the components of the embodiments as generally described herein and illustrated in the appended figures could be arranged and designed in a wide variety of different configurations. Thus, the following more detailed description of various embodiments, as represented in the figures, is not intended to limit the scope of the present disclosure, but is merely representative of various embodiments. While the various aspects of the embodiments are presented in drawings, the drawings are not necessarily drawn to scale unless specifically indicated.

The present invention may be embodied in other specific forms without departing from its spirit or essential characteristics. The described embodiments are to be considered in all respects only as illustrative and not restrictive. The scope of the invention is, therefore, indicated by the appended claims rather than by this detailed description. All changes which come within the meaning and range of equivalency of the claims are to be embraced within their scope.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussions of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize, in light of the description herein, that the invention can be practiced without one or more of the specific features or advantages of a particular embodiment. In other instances, additional features and advantages may be recognized in certain embodiments that may not be present in all embodiments of the invention.

Reference throughout this specification to "one embodiment," "an embodiment," or similar language means that a particular feature, structure, or characteristic described in connection with the indicated embodiment is included in at least one embodiment of the present invention. Thus, the phrases "in one embodiment," "in an embodiment," and similar language throughout this specification may, but do not necessarily, all refer to the same embodiment.

The present specification discloses a housing shelter for use during a disaster. More particularly, the present specification relates to a pre-cast polygonal shelter having one or more units that are capable of protecting occupants and possessions during a man-made or a natural disaster while providing life support to the occupants for a specified duration.

Disasters are often unexpected, and can have drastic effects on a wide area, causing damage to buildings, highways, and other infrastructure, and can even have severely adverse effects on air quality. In such occasions, a sturdy housing shelter may be desirable for protecting and sustaining people and protecting their possessions for a sufficient period of time until the danger from the disaster has passed.

The shelter may be designed to protect and sustain occupants from threats such as nuclear blasts or fallout, biological weaponry, epidemics, pandemics, acts of terrorism, persistent power outages, toxic spills, general warfare, home invasion, tornadoes, fires, wind, earthquakes, drought, lightning, famine, and other threats that could arise which may affect the environment or infrastructure of buildings and transportation.

While many embodiments are described herein, at least some of the described embodiments present a paneled shelter system made using pre-cast panels. More specifically, the panels are pre-cast at an off-site location and transported to an on-site location where the shelter is constructed. In some embodiments, at least some of the pre-cast panels include concrete. In other embodiments, at least some of the pre-cast panels include plastics or other materials that may provide sufficient structural support for the shelter while also providing additional advantages, such as resistance to water or other materials or elements.

Figure 1B:
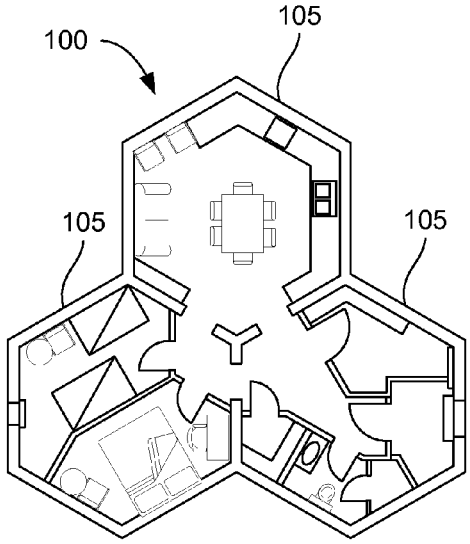
Figure 1C:
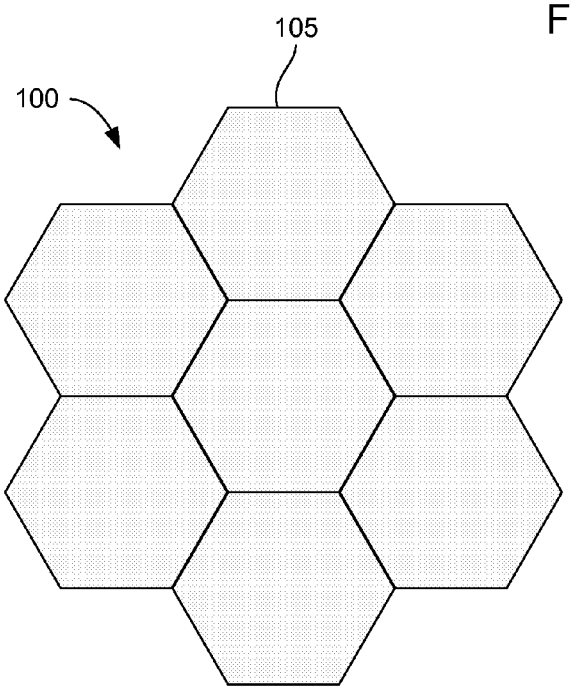

FIGS. 1A-1C show shelters 100 with different numbers of units 105 for various embodiments of the shelter 100 according to the present specification. The shelters 100 in the Figures of the present specification are shown to be hexagonal, though the shelters 100 may be designed and constructed according to any shape.

As shown in FIG. 1A, the shelter 100 may have a single hexagonal unit 105 designed to house one or more occupants and to store various belongings that may be required for living in the shelter 100 for a specified period of time. A single unit 105 may be large enough for several occupants, and may include several different partitions or rooms. Partitions may also provide privacy for the occupants and/or storage room for holding valuable or essential items. The single unit shelter 100 may include an area for sleeping, a kitchen area for cooking and eating, a space which may be used for storage, a lavatory, and/or other combinations of rooms or spaces to create a habitable environment. The unit 105 may include other areas according to design specifications and available space.

Because the shelter 100 is designed to protect occupants from the environment, an airtight, controlled environment is desired. In order to create a controlled environment, the entry may be sealed with an airtight door 110 over the entry. The shelter 100 may also have a ventilation system that will allow oxygen to be introduced into the environment. If the shelter 100 is required to sustain life for a long period of time while preventing any impurities from air outside of the shelter 100 from entering, the ventilation system may filter the air between the interior and exterior of the shelter 100. Alternatively, the shelter 100 may include its own life support system large enough to provide oxygen to the occupants for as long as needed.

The shelter 100 in FIG. 1B shows a three unit shelter 100 according to one embodiment. A shelter 100 having more than a single unit 105 can be arranged in a number of ways. In the present embodiment, the units 105 are arranged such that each unit 105 adjoins two other units 105. Constructing a shelter 100 with more units 105 allows for more living and storage space. For example, a three-unit shelter 100 in FIG. 1B has more space for additional rooms, for example a larger dining room area with extra seating and more counter space, than the single-unit shelter 100 in FIG. 1A. A larger shelter 100 may also include more living quarters, wash rooms, or storage space.

The hexagonal shape of the units 105 also allows for more flexibility in design. While design and style are not necessary components of a shelter system, greater flexibility in such areas may be desired, particularly when the shelter 100 is designed to be habitable for an extended period of time. The shelter 100 in FIG. 1C is a shelter 100 having a plurality of units 105 arranged in a cluster that resembles a beehive. Such a structure allows relatively quick access from one area of the shelter 100 to another—for example, the center unit 105 is connected to all six of the units 105 surrounding it.

Many other shelter design combinations are possible using the hexagonal units 105, units 105 with more or fewer sides, or a combination of units 105 with different numbers of sides. In a larger shelter cluster, the shelter 100 may have more than one vent to the ventilation system to allow for more air circulation, and may have more than one entry. Each individual unit 105 may have a vent to the ventilation system in case one or more of the units 105 is closed or sealed off from the rest.

Figure 2A:
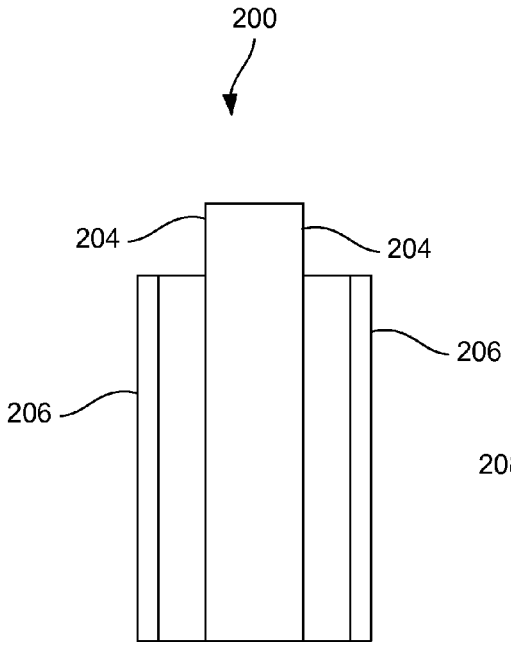
FIGS. 2A-2B are illustrative diagrams showing an exterior panel and an interior panel, according to principles described herein.
Figure 2B:
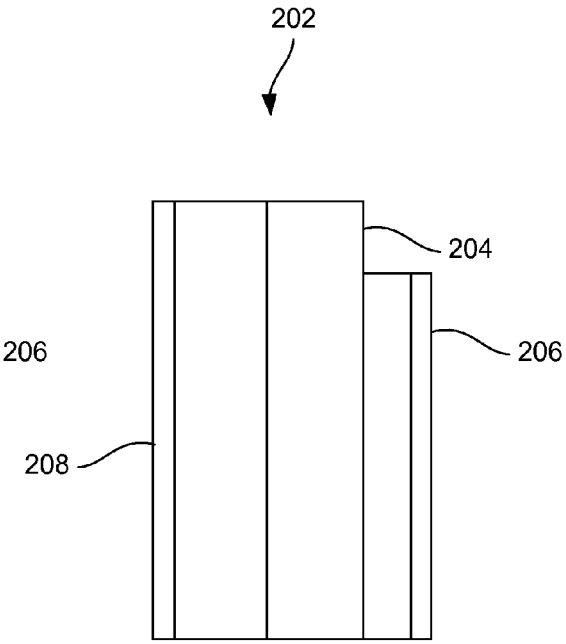

FIGS. 2A and 2B illustrate side views of interior and exterior wall panels 200, 202 according to one embodiment of the present specification. The exterior wall panel 202 in FIG. 2B has an inset 204 at an inner surface 206 of the panel 202 against which a ceiling panel may abut. The outer surface 208 of the exterior panel 202 is higher than the inset 204 of the interior surface 206 of the exterior panel 202 so that when the ceiling panel is placed over the unit 105, the ceiling panel rests in the inset 204. The interior panel 200 in FIG. 2A has two insets 204 at each inner surface 206 because each interior panel 200 supports two ceiling panels, one in each inset 204.

A unit 105 having all exterior wall panels 202 of the same size may allow for cheaper and easier construction because the pre-cast panels may be cast using a minimal amount of equipment. According to one embodiment, the interior panels 200 may be the same size as the exterior wall panels 202, such that the interior panels 200 are made using the same pre-casting equipment as the exterior panels. In another embodiment, the interior panels 200 may be thinner than the exterior panels 202, but may be the same size and length as other interior panels 200.

The width of each of the exterior panels 202 may be identical in order to facilitate casting and to lower costs. The exterior panels 202 may be thick enough to provide structural support for the shelter 100, while at the same time providing protection for the occupants from the external environment. Underground shelters 100 must not only be able to support the weight of the ceiling panels and other roofing materials, but must also be able to support any dirt, soil or other materials used to cover the shelter 100. This is particularly helpful when the shelter 100 is to be used for protection from explosives, nuclear blasts, nuclear fallout, biological weapons, and pestilences. Thick, solid walls and an underground location may help reduce or eliminate threats from the outside environment.

The width of each of the interior panels 200 may also be identical to each other. The interior panels 200 are strong enough to support the ceiling panels for each of the units 105. Some shelters 100 may have many units 105 clustered together, as in FIG. 10, so that many of the junctions between units 105 include only interior panels. Such three-panel connections must be structurally sound and able to withstand any weight placed upon it by roofing materials, and if underground, any materials used to cover the shelter 100.

In an alternative embodiment, the width of all of the panels is identical irrespective of whether the panel is an interior or an exterior panel. In such an embodiment, the interior panels 200 may be thicker in some embodiments, or the exterior panels 202 may be thinner so that each of the exterior panels 202 and interior panels 200 has the same width according to a particular design specification. The inset 204 of each of the panels may be adjusted accordingly in order to support the ceiling panels.

Figure 3A:
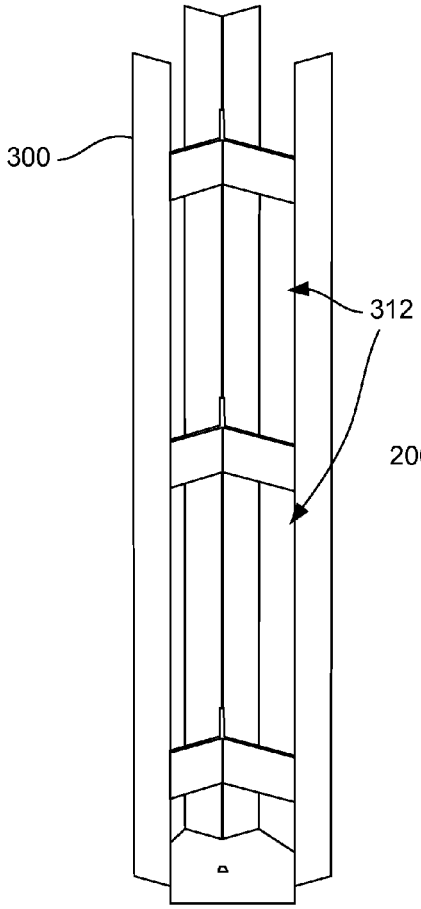
FIGS. 3A-3D are illustrative diagrams showing panel connectors, according to various embodiments of principles described herein.
Figure 3B:
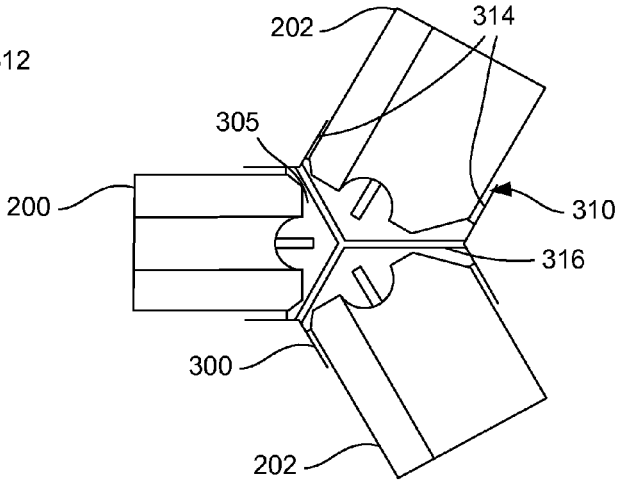

FIGS. 3A-3D show various panel connectors 300 which may be used according to one embodiment of the present specification. In some embodiments, the connectors 300 are placed at each corner of the polygonal floor surface. In other embodiments, the connectors 300 are placed at only some of the corners of the polygonal floor surface, such that a wall panel, either an exterior panel 202 or interior panel 200, is shaped to fit to multiple sides of the polygonal floor surface. The wall panels may be positioned by sliding the panels down slots 310 in the connectors 300. The connectors 300 also include openings 312 between the slots 310. The slots 310 may also be referred to as channels 310. Each channel 310 is formed from two parallel flanges 314 connected by a web 316 in the connectors 300, as shown in FIG. 3B. The openings 312 are located in the web of each channel 310 in the connector 300, as shown in FIG. 3A.

FIG. 3A shows an exterior 3-panel connector 300 for connecting two exterior wall panels 202 with an interior wall panel 200, and FIG. 3B shows a two-dimensional plan view of the exterior two-panel connector 300. The three-panel connector 300 shown is a connector 300 placed at an exterior junction of two exterior wall panels 202 and an interior wall panel 200, which may be located at the exterior junction between two units 105. The portion of the panel connector 300 fitted to the interior wall panel 200 may be narrower than the each of the portions of the panel connector 300 fitted to the two exterior wall panels 202 because the exterior panels 200 may be thicker than the interior panels 202. Thicker walls along the exterior may be desirable for structural support, and thinner walls in the interior of the shelter 100 may help maximize space within the shelter 100.

In a shelter 100 using a hexagonal shape, the three-panel connector 300 is designed so that an angle of 120 degrees is between each panel when inserted into the connector, based on the geometry of a hexagon. In other embodiments in which the units 105 are not hexagonal, but are some different polygonal shape, the connector may be designed accordingly so that the panels are spaced according to the geometry of the shape.

In an alternative embodiment in which the interior wall panels 200 are the same width as the exterior wall panels 202, the portion of the connector 300 fitted to the interior wall panel 200 may be as wide as the portions of the connector 300 fitted to the exterior wall panels 200, such that the three-panel connector 300 is symmetrical.

A grout 305 and/or sealant or other adhesive material may be inserted into the panel connector 300 between the panels in order to join and stabilize the walls within the connector, and also to help seal the connector 300 after the grout is solidified. In one embodiment, the grout is used to fill at least one opening 312 and each channel 310 in the connector 300. In one embodiment, the grout may be a high strength grout for concrete. Additionally, the wall panels may have a bar or bars, such as a steel "T" bar, embedded within the panels, such that the bar extends from the end of the panel. The bar extends into the grout that is inserted in the panel connectors 300 between the panels, and may provide further structural support for the wall panels.

Figure 3C:
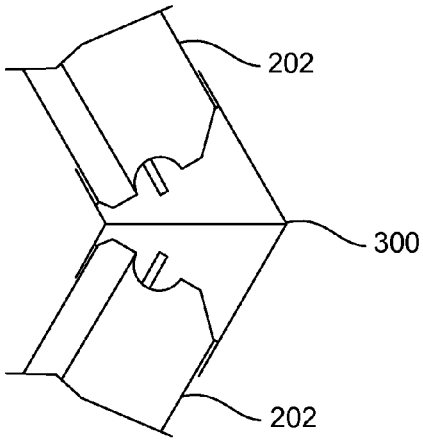
Figure 3D:
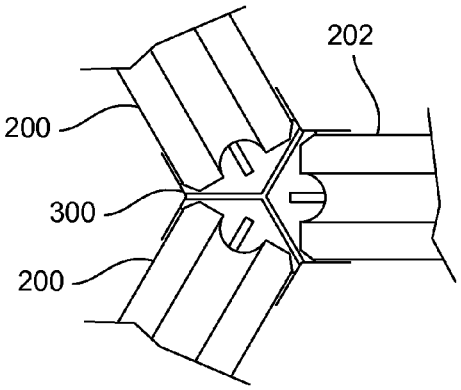
Figure 4A:
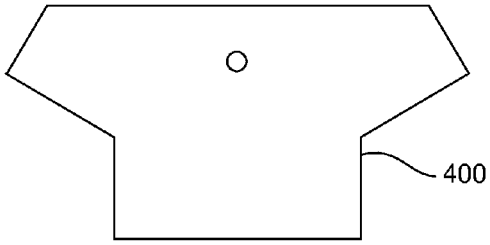
FIGS. 4A-4D are illustrative diagrams showing various embodiments of floor connector plates, according to various embodiments of principles described herein.
Figure 4B:
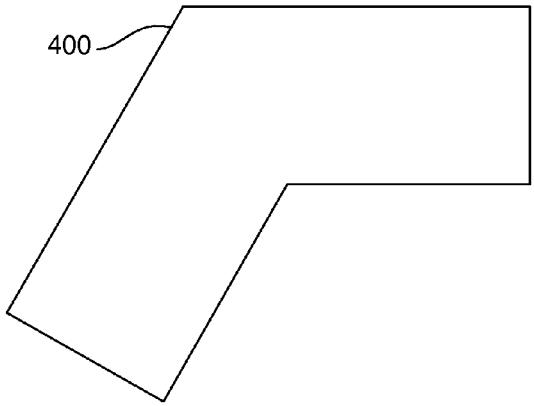
Figure 4C:
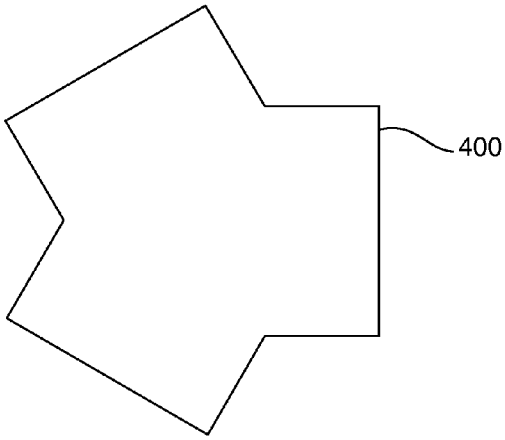
Figure 4D:
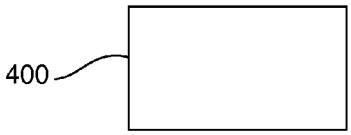

FIG. 3C shows a plan view of a two-panel connector 300. The two-panel connector 300 is a connector placed at a junction between two exterior panels 202 of a single unit 105. The width of each portion of the two-panel connector 300 is equal so as to receive two wall panels of equal width. FIG. 3D shows a plan view of an interior three-panel connector 300. This connector 300 may be positioned at the junction between three adjacent units 105 in a multi-unit shelter 100. Each slot of the interior three-panel connector 300 is designed to receive three interior wall panels 200 such that each slot is the same width. In some embodiments, at least one of the interior wall panels 200 may be a different width than the others.

FIGS. 4A-4D are illustrative diagrams showing various embodiments of floor connector plates 400, according to various embodiments of principles described herein. A connector plate 400 may be placed at the junction between one or more floor panels and one or more wall panels. The connector plates 400 may be used to weld multiple panels together to provide structural stability once the panels are placed in the corresponding positions. The plates 400 may include various sections welded together on-site. The shape of the connector plate 400 may depend on the position of the connector plate 400 with respect to the wall panel and floor panel, as well as the number of components the plate 400 is used to weld together. In some embodiments, the plates 400 may be placed flush with an edge of the wall panel or floor panel. In some embodiments, the wall panels include indentations where the plates 400 are positioned and connected to the panels. In some embodiments, the plates 400 are positioned underneath at least one wall panel and proximate the floor panel.

In one embodiment, at least part of a connector plate 400 is connected to a wall panel or floor panel before transporting the panel to the on-site location. This may be accomplished by placing the part of the connector plate 400 in the appropriate position when pre-casting the panel. Consequently, when the panels are installed on-site, the various parts of the connector plate 400 will be positioned proximate each other such that the parts may be welded together on-site to hold the panels in place. Other embodiments of the panels and/or connector plates 400 may connect the plates 400 to the panels in other ways not described herein.

Figure 5A:
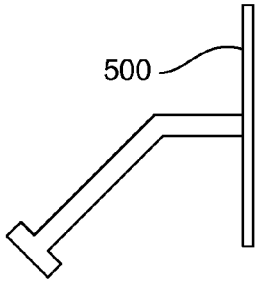
FIGS. 5A-5B are illustrative diagrams showing a ceiling connector plate, according to various embodiments of principles described herein.
Figure 5B:
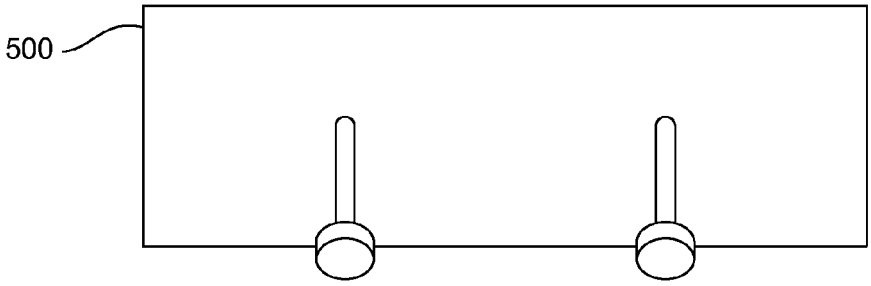

FIGS. 5A-5B are illustrative diagrams showing various embodiments of ceiling connector plates 500, according to various embodiments of principles described herein. The ceiling connector plates 500 may be placed at the junction between one or more ceiling panels and one or more wall panels. The connector plates 500 may be used to weld multiple panels together to provide structural stability once the panels are placed in the corresponding positions. The plates 500 may include various sections welded together on-site. The shape of the connector plate 500 may depend on the position of the connector plate 500 with respect to the wall panel and ceiling panel, as well as the number of components the plate 500 is used to weld together.

In one embodiment, at least part of a connector plate 500 is connected to a wall panel or floor panel before transporting the panel to the on-site location. This may be accomplished by placing the part of the connector plate 500 in the appropriate position when pre-casting the panel. Consequently, when the panels are installed on-site, the various parts of the connector plate 500 will be positioned proximate each other such that the parts may be welded together on-site to hold the panels in place. Other embodiments of the panels and/or connector plates 500 may connect the plates 500 to the panels in other ways not described herein.

Figure 6:
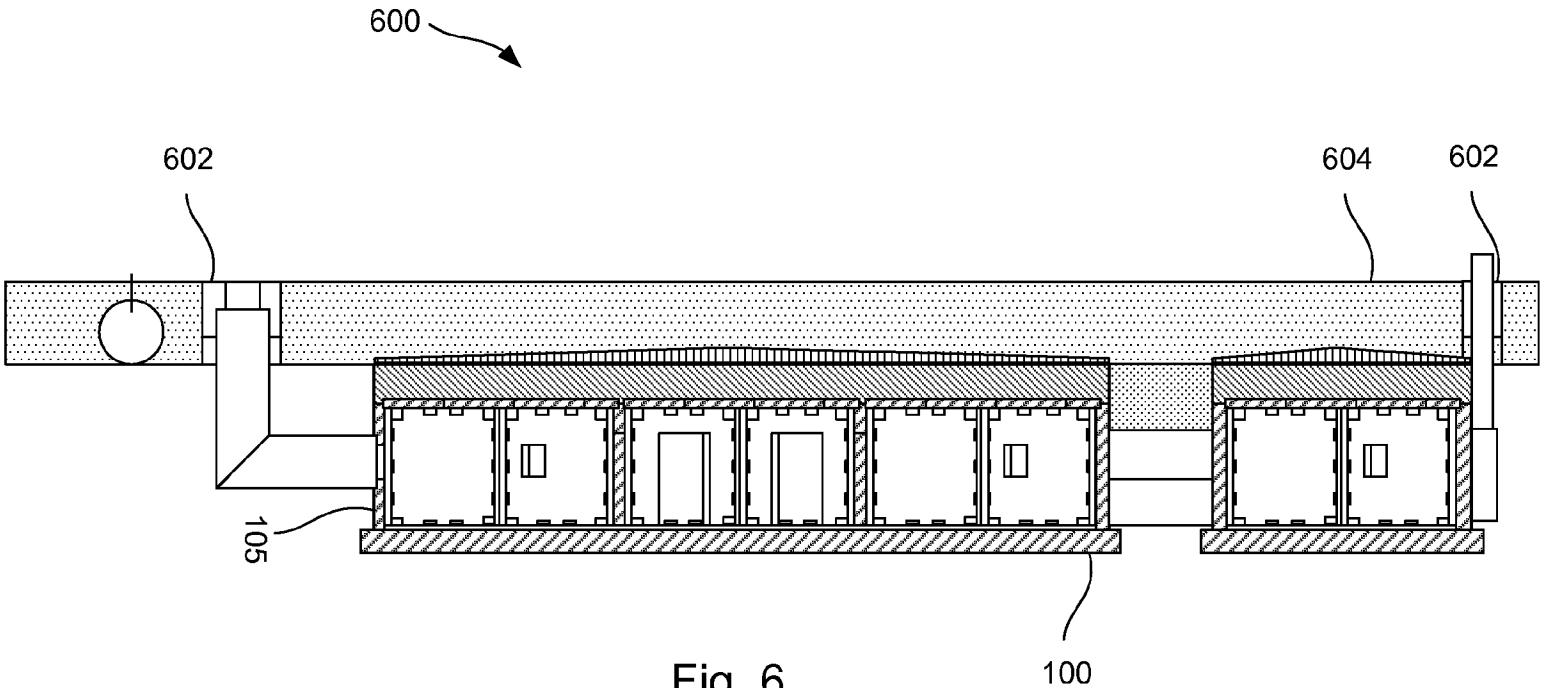
FIG. 6 is an illustrative diagram of an underground housing shelter network, according to principles described herein.

The shelter 100 may have more than one cluster of units 105 arranged in a partially or fully connected network 600 of clusters, as shown in the embodiment of FIG. 6. The underground shelter 100 may have several openings 602 to the surface 604. At least one of the openings 602 may provide the shelter 100 with oxygen. The oxygen may be filtered through an air purification system before being introduced into the shelter 100. Alternatively, the air may be directly introduced into the shelter 100, depending on the design specifications of the shelter 100. Carbon dioxide and/or unwanted gases or fumes may be routed through the same surface opening 602 or through a different opening 602.

The shelter 100 may also have a pipe or series of pipes connected to the shelter 100 for waste disposal. The waste disposal system in the shelter 100 may be connected to a main waste disposal system that also connects to a main residence or to other residences. In some embodiments, the shelter 100 may have a waste disposal system that feeds into a separate septic tank.

In some shelters 100, it may be desirable to have a water source that is separate from a main water system in case the main water system becomes contaminated. The shelter 100 may have room within the units 105 for containers that are capable of storing water for an extended period of time. In another embodiment, the shelter 100 may have a water system connected to a large water storage tank. The shelter 100 may have water pipes running to any showers, sinks, toilets, and any appliances or other items or locations within the shelter 100.

The network of shelters 100 may be connected via air or water ducts, and may also be connected via passages that allow occupants to go from one cluster of the shelter network to another cluster without going above ground. In other embodiments, some of the shelter network 600 may share the same ventilation system, but may not be accessible from other clusters except through a primary entrance.

Figure 7:
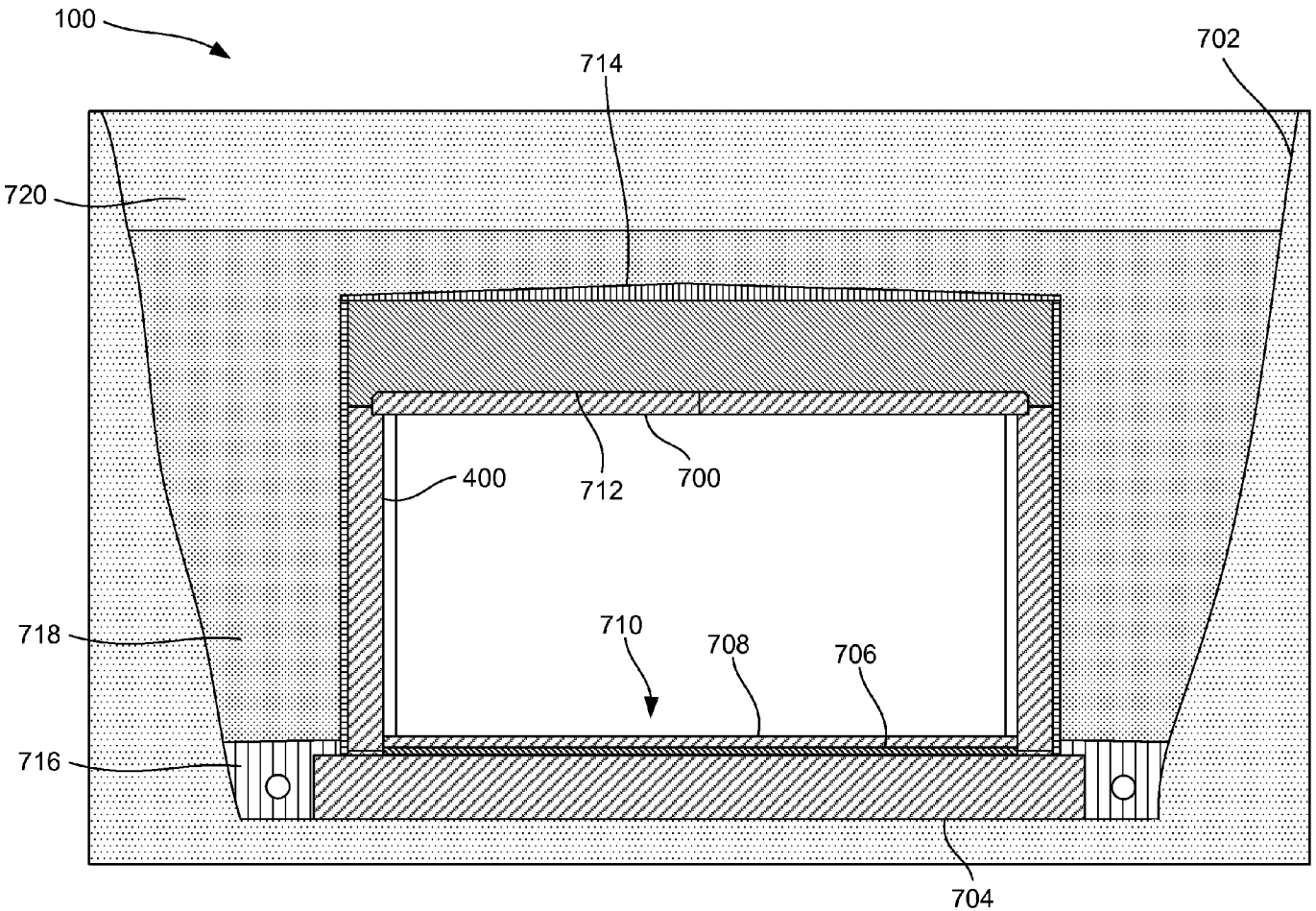
FIG. 7 is an illustrative diagram of a housing unit below ground surface, according to principles described herein.

A cross-section of a single unit shelter 100 is shown in FIG. 7. As shown, the shelter 100 may be an underground shelter 100. When constructing the shelter 100, the wall panels 202 and ceiling panels 700 are pre-cast at an off-site location, such as a manufacturing plant. For an underground shelter 100, a hole 702 is dug at the on-site location where the shelter 100 is to be built.

The hole 702 may be deep enough for the roof of the shelter 100 to be below the ground surface. A base 704 may then be placed in the hole 702 as a simple foundation. According to one embodiment, the base 704 includes a concrete slab that is cast-in-place at the on-site location, though the base 704 may be made of materials other than concrete. A polygonal polymer board 706, such as a polyiso board or other foam/insulation material, may then be placed on top of the base concrete slab and a second, thinner concrete slab 708 having the same shape as the polymer board 706 may be cast-in-place on top of the polymer board. Floor insulation may help maintain temperature and moisture control within the shelter 100. Both the polymer board 706 and the second concrete slab 708 may form a polygonal floor surface 710 that has the shape that the unit 105 will have, such as a hexagon, though the polygonal floor surface 710 may include or be made of other materials. The second concrete slab 708 may cover weld taps at the base of the wall panels 202 where the floor connector plates 400 have been welded together. The second concrete slab 708 may also help with moisture control by lifting the floor higher.

Once the base 704 and polygonal floor surface 710 are set, the components that were manufactured off-site may be used to construct the rest of the shelter 100. Panel connectors 300 may then be attached to the base 704 at the corners of the floor surface 710 where the ends of wall panels 202 are to meet. The wall panels 202 are placed on top of the base 704 adjacent the edges of the polyiso board 706 and second concrete slab 708 and in between the panel connectors 300. The ends of the wall panels 202 may fit within the panel connectors 300, such that each end of each wall panel 202 is disposed within a panel connector 300. A high strength grout may be inserted into the panel connectors 300 such that when the grout solidifies it holds the wall panels 202 in place and helps provide structural support for the shelter 100.

In one embodiment, at least one ceiling panel 700 is placed on top of the wall panels 202. In other embodiments, more than one ceiling panel 700 may be placed on top of the wall panels 202 in order to cover the unit 105. The ceiling panel 700 may be a pre-cast concrete slab having the same shape as the floor surface 710, though with a greater circumference so that there is enough overlap with the wall panels 202 that the ceiling panel 700 rests securely on top of the wall panels 202. The ceiling panel 700 may be made of materials other than concrete.

A concrete roof slab 712 may then be cast-in-place to cover the ceiling panel 700 and any exposed portion of the wall panels 202 to help fix the various components in place. The cast-in-place roof slab 712 also provides support for the shelter 100 when the shelter 100 is buried underneath the surface 604. The shelter 100 may also have a waterproof covering 714 or membrane that covers the outer walls 202 and concrete slab 712—such as a foam board on top of the roof slab and a waterproofing skin around the exterior of the shelter 100—in order to prevent water from entering into the shelter 100 or potentially damaging the structure. The covering 714 may be tapered on the roof to help drain water or other liquids from above the shelter 100.

The hole 702 in which the shelter 100 is constructed may be filled with several materials. A layer of drain rock 716 or drain materials having a trench drain may be deposited around the perimeter of the shelter base. This layer of drain rock 716 may be used to collect and transfer moisture away from the shelter 100. A layer of gravel 718 may then be deposited in the hole, covering the shelter 100 completely. The layer of gravel 718 and layer of drain rock 716 may help quickly drain water that seeps into the ground in the area above and surrounding the shelter 100. A layer of dirt 720 and/or topsoil may then be deposited on top of the gravel, completely filling the hole.

Figure 8:
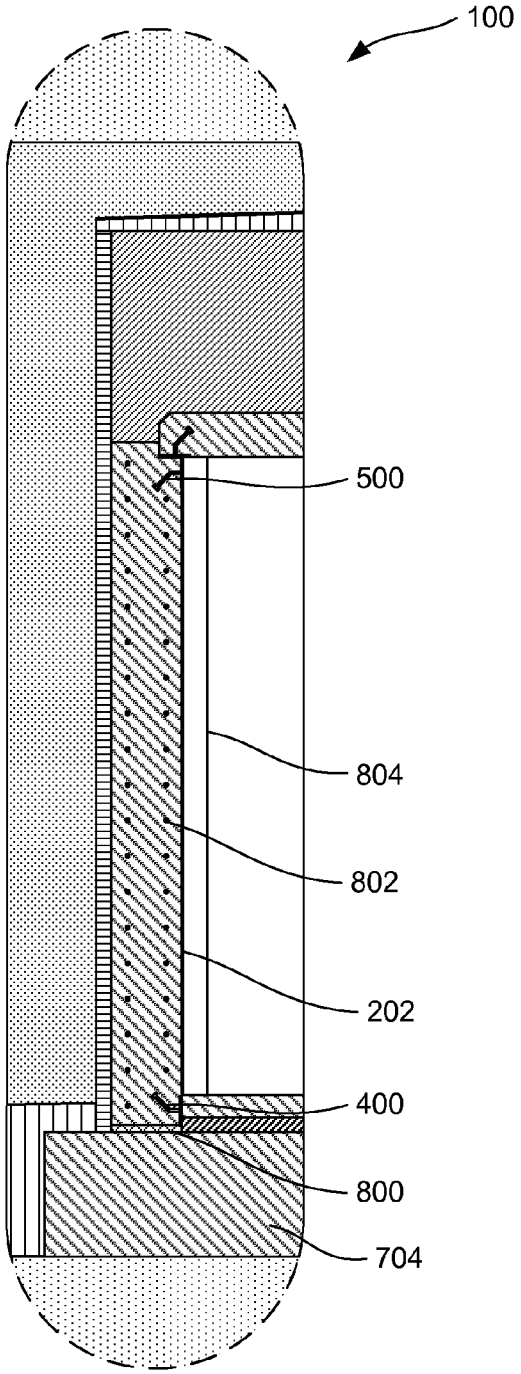
FIG. 8 is a close-up partial illustrative diagram of a housing unit below ground surface, according to principles described herein.

FIG. 8 shows a close-up, partial view of the shelter 100 cross-section of FIG. 7. A layer of non-shrink grout 800 may be deposited on the base 704 where the wall panels 202 are to be placed before placing the wall panels 202. The non-shrink grout 800 may help prevent water from seeping into the shelter 100 at the base 704 where the covering 714 and wall panels 202 meet the base 704. In some embodiments, the grout 800 beneath the wall panels 202 may be as much as an inch thick. Once solidified, this may help stabilize the wall panels 202 as well as prevent seepage.

The exterior wall panels 202 may also have a thickness of about twelve inches, according to one embodiment. Metal bars 802 may be embedded at least partially within the wall panels 202. Two vertical columns of bars 802 may be spaced vertically and horizontally with sufficient clearance from the surfaces of the wall panels 202 in order to provide optimal structural support. Additionally, the connector plates 400, 500 may be positioned within the wall panels and ceiling panels or floor panels. The ceiling panel 700 may have a thickness of about eight inches and may also include a row of bars 802. The base 704 may have a thickness of about twenty-one inches, also with two rows of metal bars 802 disposed within the base. Other embodiments of shelters 100 may include components with different measurements.

The shelter 100 may have an additional surface 804 or panel at each exterior wall panel. In one embodiment in which the wall panels 202 are concrete wall panels 202, for example, a pressure treated wood surface 804 may be attached to the inner surface 206 of the concrete wall panels 202, which may provide a smoother surface than a concrete wall panel would otherwise provide. Additionally, insulation may be added to the interior surface of the wall panels or otherwise added to the exterior wall panels 202 to help maintain a controlled environment within the shelter 100.

Figure 9A:
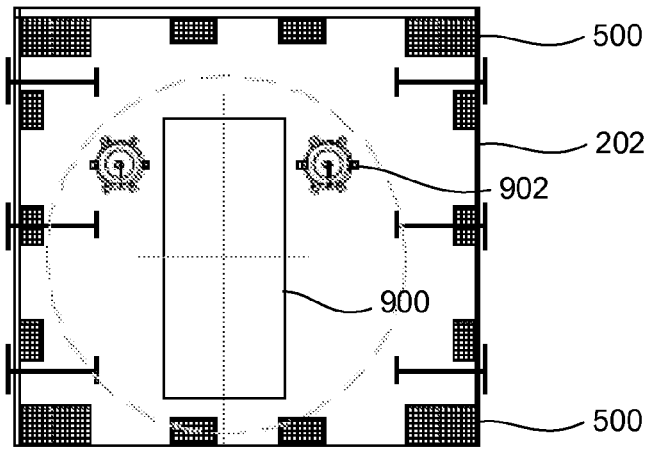
FIG. 9A-9C are illustrative diagrams of wall panels, according to principles described herein.
Figure 9B:
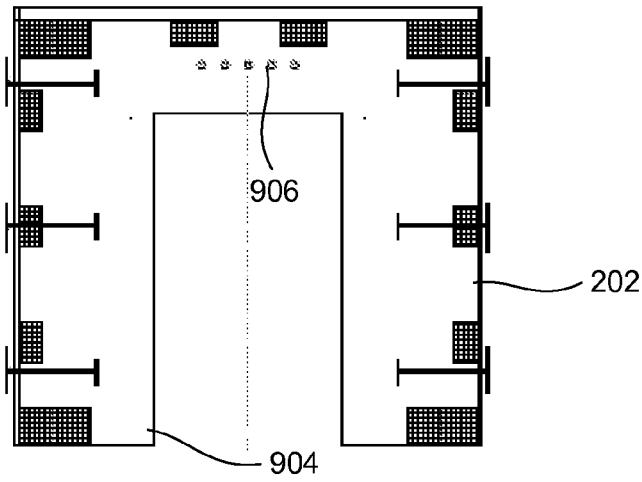
Figure 9C:
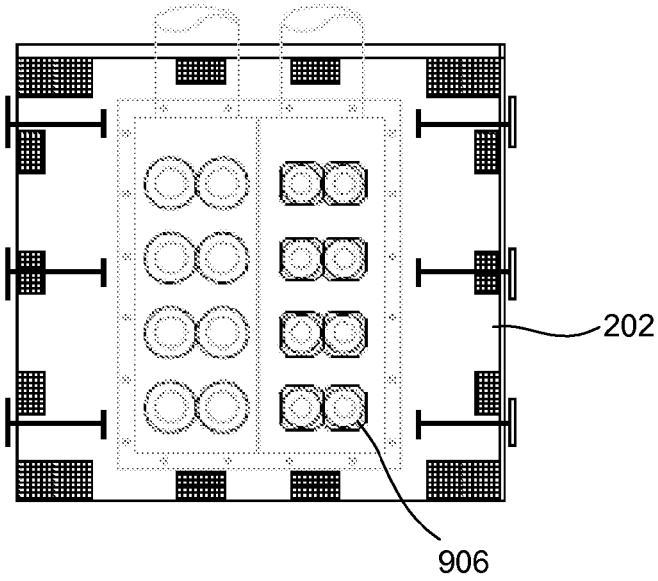

FIGS. 9A-9C illustrate several embodiments of wall panels 202 that may be used in accordance with the present specification. FIG. 9A is a wall panel 202 with a blast door 900. The wall panel 202 has an opening through which occupants may enter. The blast door 900 may have locks 902 to help seal the interior of the shelter 100 from the exterior. The locks 902 may provide an airtight seal. Additionally, the door locks 902 and blast door 900 may be highly durable so as to help prevent intrusion during a home invasion or similar event.

The wall panels 202 may include embedded steel plates with welded reinforcing, such as the connector plates 400, 500, to help hold the panels in place with respect to the floor surface 710 and ceiling panels 700. This may help provide structural stability for the shelter 100.

FIG. 9B shows an interior wall panel 200 having an opening for a doorway 904 or passageway between units 105 in the shelter 100. The wall panels 200 may have other openings for ventilation or other purposes. Some or all of the wall panels—either interior or exterior—may have openings 906 that allow electrical conduits to run from one unit 105 in the shelter 100 to another unit 105 or from the outside into the shelter 100 in order to provide electricity to each of the units 105 and to appliances, lights, and other amenities in the shelter 100. Additional conduits may transport water from a water source into the shelter 100—for example, into the bathroom/lavatory area and the kitchen.

According to one embodiment, the amount of time in which the shelter 100 is capable of sustaining life may be determined beforehand by the nature of the disaster from which it is designed to protect. In another embodiment, the shelter 100 may be designed to protect against any type of disaster, whether anticipated or not.

FIG. 9C shows an exterior wall panel 202 having a plurality of openings 906. Each opening 906 may allow for a pipe sleeve or other casings to pass through the wall. The pipe sleeves may be used to create conduits for water, waste, ventilation, heating, wiring, or other components. The conduits may be routed through the exterior wall panel 202 to interior appliances, machines, or devices to create a habitable or even comfortable living atmosphere within the shelter 100. The conduits may connect one section of the shelter 100 to another section of the shelter 100, or to exterior devices, such as pumps, filters, or generators. In some embodiments, interior wall panels 200 in the shelter 100 may also include openings to allow various conduits to pass through the interior wall panels 200 into other rooms within the shelter 100. Because the wall panels are pre-cast, the shelter 100 may be custom designed to meet many different preferences or requirements.

Figure 10:
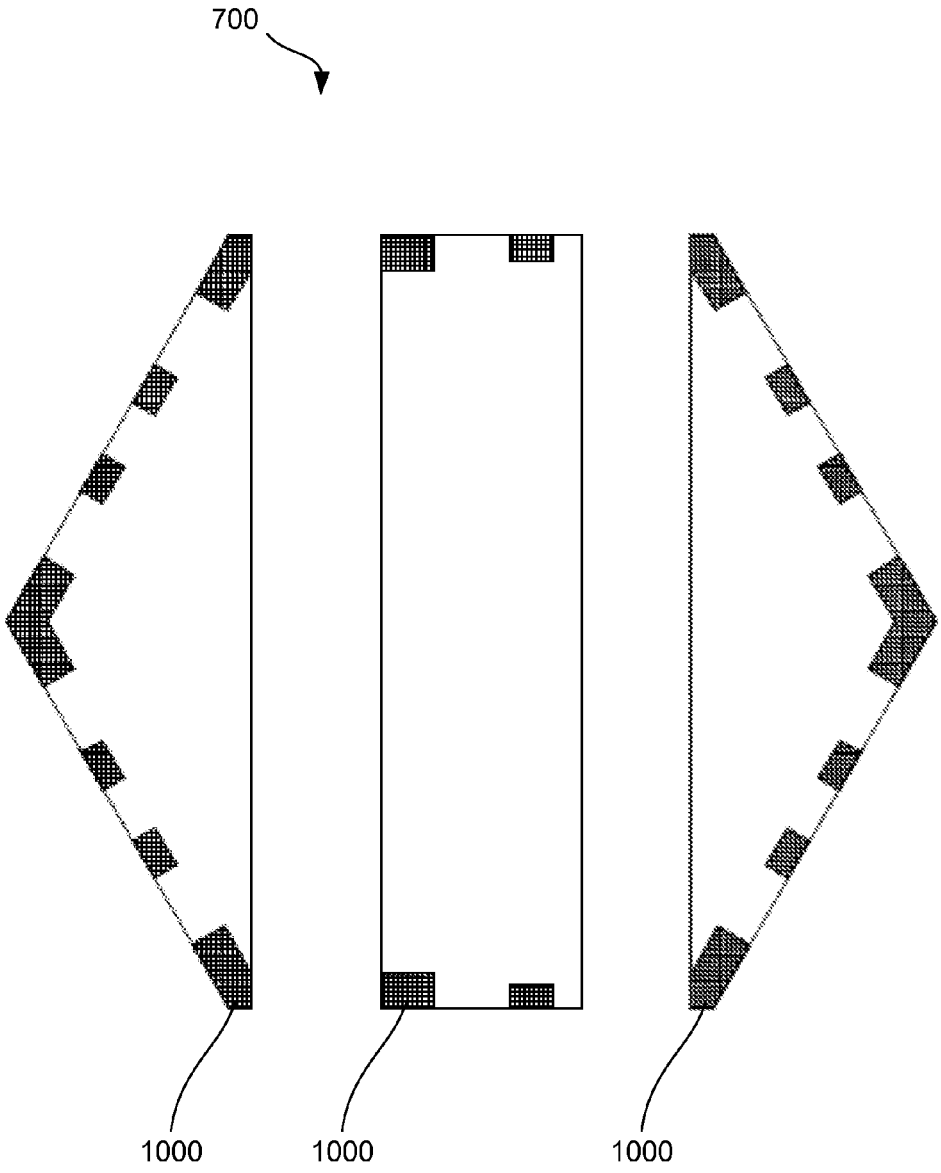
FIG. 10 is an illustrative diagram of ceiling panels, according to principles described herein.

FIG. 10 shows a plurality of ceiling panel sections 1000 in a ceiling panel 700. Several ceiling panel sections 1000 may be used to cover a single unit 105. Alternatively, a single ceiling panel 700 may cover an entire unit 105. The ceiling panel sections 1000 for a single unit 105 may collectively cover the entire unit 105, such that each of the wall panels for the unit 105 is in contact with at least one ceiling panel section 1000. In some embodiments, a wall panel may be in contact with more than one ceiling panel section 1000. In some embodiments, a ceiling panel section 1000 may be in contact with more than one wall panel. Each ceiling panel section 1000 may be joined to the wall panels using the welded connector plates 500. In some embodiments, each ceiling panel section 1000 may be joined to other ceiling panel sections 1000 using welded connector plates 500 to provide additional structural support for the ceiling.

Figure 11:
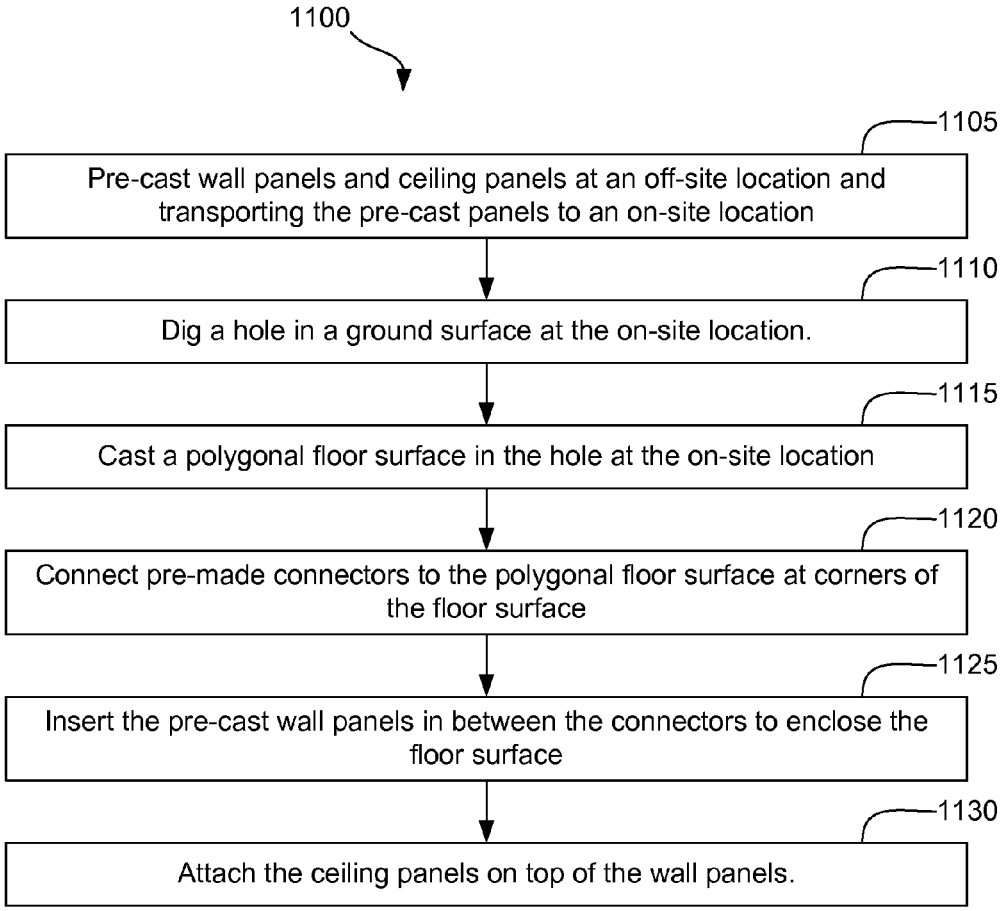
FIG. 11 is an illustrative flow chart diagram of a method for constructing a unit of a pre-cast housing shelter, according to principles described herein.

FIG. 11 is an illustrative flow chart diagram of a method 1100 for constructing a unit of a pre-cast housing shelter, according to principles described herein. The method 1100 includes: pre-casting 1105 wall panels and a ceiling panel at an off-site location and transporting the wall panels and the ceiling panel to an on-site location; casting 1115 a polygonal floor surface at the on-site location; connecting 1120 a plurality of pre-made connectors to the polygonal floor surface, wherein each of the pre-made connectors is placed at a corner of the polygonal floor surface; inserting 1125 the wall panels in between the connectors, wherein the wall panels enclose the polygonal floor surface; and attaching 1130 the ceiling panel on top of the wall panels.

In some embodiments, the method includes digging 1110 a hole in a ground surface at the on-site location in which the polygonal floor surface is cast. In some embodiments, the method includes covering an exterior surface of the unit with a waterproofing skin; and depositing a drain material around the exterior of the shelter within the hole, wherein the drain material directs fluid away from the shelter. In some embodiments, the method includes casting a ceiling slab to cover the unit; and covering the unit with a cover layer to bury the shelter underground, wherein the cover layer comprises an opening to grant access to the unit. In some embodiments, the method includes field welding any adjacent wall panels, floor panels, or ceiling panels together using connector plates to lock the panels in place. In some embodiments, the method includes filling the pre-made connectors with an adhesive material, wherein the adhesive material holds the wall panels in place and creates a seal.

In the above description, specific details of various embodiments are provided. However, some embodiments may be practiced with less than all of these specific details. In other instances, certain methods, procedures, components, structures, and/or functions are described in no more detail than to enable the various embodiments of the invention, for the sake of brevity and clarity.

Although the operations of the method(s) herein are shown and described in a particular order, the order of the operations of each method may be altered so that certain operations may be performed in an inverse order or so that certain operations may be performed, at least in part, concurrently with other operations. In another embodiment, instructions or sub-operations of distinct operations may be implemented in an intermittent and/or alternating manner.

Although specific embodiments of the invention have been described and illustrated, the invention is not to be limited to the specific forms or arrangements of parts so described and illustrated. The scope of the invention is to be defined by the claims appended hereto and their equivalents.

What is claimed is:

1. A pre-cast housing shelter unit comprises:

a hexagonal floor surface;

a plurality of pre-cast wall panels arranged in a hexagonal shape adjacent the floor surface;

a plurality of pre-made connectors attached to the hexagonal floor surface between adjacent wall panels at corners of the hexagonal floor surface, wherein each of the plurality of pre-made connectors comprises:

a plurality of channels, each of the plurality of channels formed from two parallel flanges connected by a web, wherein each of the plurality of channels is configured to receive one of the adjacent wall panels; and at least one opening formed in the web of each of the plurality of channels joining the plurality of channels; wherein the at least one opening and the plurality of channels are filled with a grout configured to join and stabilize the adjacent wall panels together within each of the plurality of connectors;

at least one ceiling panel attached to the plurality of wall panels, wherein the housing shelter is sealed, wherein the plurality of connectors extend from the floor surface to the at least one ceiling panel; and a cast-in-place ceiling slab covering the at least one ceiling panel, the plurality of pre-cast wall panels, and the plurality of pre-made connectors.

2. The shelter unit of claim 1, in which the hexagonal floor surface is formed in a hole in an on-site location.

3. The shelter unit of claim 1, in which the plurality of wall panels comprise concrete.

4. The shelter unit of claim 1, in which the plurality of wall panels comprise a plastic material.

5. The shelter unit of claim 1, in which the hexagonal floor surface comprises a cast-in-place concrete surface.

6. The shelter unit of claim 5, further comprising a cast-in-place concrete slab beneath the hexagonal floor surface, wherein the hexagonal floor surface further comprises a polygonal polymer board underneath the cast-in-place concrete surface, wherein the cast-in-place concrete slab comprises a thickness greater than the hexagonal floor surface and supports the plurality of wall panels.

7. The shelter unit of claim 5, further comprising a waterproof covering that covers an exterior surface of the shelter unit.

8. A pre-cast housing shelter, comprising:

a plurality of hexagonal units, each of the units comprising:

a hexagonal floor surface;

a plurality of pre-cast wall panels arranged in a hexagonal shape adjacent the floor surface;

a plurality of pre-made connectors attached to the hexagonal floor surface between adjacent wall panels at each corner of the hexagonal floor surface, wherein each of the plurality of pre-made connectors comprises:

a plurality of channels, each of the plurality of channels formed from two parallel flanges connected by a web, wherein each of the plurality of channels is configured to receive one of the adjacent wall panels; and a plurality of openings formed in the web of each of the plurality of channels joining the plurality of channels; wherein the plurality of openings and the plurality of channels are filled with a grout configured to join and stabilize the adjacent wall panels together within each of the plurality of connectors;

at least one ceiling panel attached to the plurality wall panels, wherein the plurality of pre-made connectors extend from the floor surface to the at least one ceiling panel; and a cast-in-place ceiling slab covering the at least one ceiling panel, the plurality of pre-cast wall panels, and the plurality of pre-made connectors.

9. The shelter of claim 8, in which the plurality of hexagonal units are arranged in a beehive pattern.

10. The shelter of claim 8, in which at least some of the hexagonal units comprise openings into adjoining hexagonal units.

11. The shelter of claim 8, in which the polygonal floor surface for each hexagonal unit is cast-in-place in a hole in an on-site location.

12. The shelter of claim 11, further comprising:

a waterproof covering around an exterior of the shelter;

a drain material around the exterior of the shelter within the hole, wherein the drain material is configured to direct fluid away from the shelter; and a cover layer over the shelter to cover the shelter underground, wherein the cover layer comprises an opening to grant access to the shelter.

13. A method for constructing a unit of a pre-cast housing shelter, comprising:

casting a hexagonal floor surface at an on-site location;

connecting a plurality of pre-made connectors to the hexagonal floor surface, wherein each of the plurality of pre-made connectors is placed at a corner of the hexagonal floor surface;

inserting pre-cast wall panels in between the plurality of pre-made connectors, wherein the wall panels enclose the hexagonal floor surface, wherein each of the plurality of pre-made connectors comprises:

a plurality of channels slats, each of the plurality of channels formed from two parallel flanges connected by a web, wherein each of the plurality of channels is configured to receive one of the adjacent wall panels; and at least one opening formed in the web of each of the plurality of channels joining the plurality of channels; inserting a grout into the at least one opening and the plurality of channels clots of each of the plurality of connectors, wherein the grout is configured to join and stabilize the adjacent wall panels together within each of the plurality of connectors;

attaching at least one pre-cast ceiling panel on top of the wall panels, wherein the plurality of pre-made connectors extend from the floor surface to the at least one ceiling panel; and casting a ceiling slab to cover the at least one pre-cast ceiling panel, the pre-cast wall panels, and the plurality of pre-made connectors.

14. The method of claim 13, further comprising digging a hole in a ground surface at the on-site location in which the hexagonal floor surface is cast.

15. The method of claim 14, further comprising:

covering an exterior surface of the unit with a waterproof covering; and depositing a drain material around the exterior of the shelter within the hole, wherein the drain material directs fluid away from the shelter.

16. The method of claim 14, further comprising:

covering the unit with a cover layer to bury the shelter underground, wherein the cover layer comprises an opening to grant access to the unit.

17. The method of claim 13, further comprising:

field welding each wall panel to each adjacent wall panel, adjacent floor surface, and adjacent at least one ceiling panel using connector plates at least partially disposed within each corresponding wall panel, adjacent wall panels, adjacent floor surface, and at least one adjacent ceiling panel.

* * * * *